US010304363B2

(12) United States Patent
Kabatek et al.

(10) Patent No.: US 10,304,363 B2
(45) Date of Patent: May 28, 2019

(54) TEST METHOD FOR A SCREEN IN A VEHICLE

(71) Applicant: CONTINENTAL AUTOMOTIVE GMBH, Hannover (DE)

(72) Inventors: Ulrich Kabatek, Babenhausen (DE); Gerhard Müller, Alsbach (DE); Reiner Schmidt, Hainburg (DE); Kai Hohmann, Babenhausen (DE); Torsten Lahr, Zornheim (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 14/899,844

(22) PCT Filed: May 28, 2014

(86) PCT No.: PCT/EP2014/061073
§ 371 (c)(1),
(2) Date: Apr. 5, 2016

(87) PCT Pub. No.: WO2014/202367
PCT Pub. Date: Dec. 24, 2014

(65) Prior Publication Data

US 2016/0217719 A1 Jul. 28, 2016

(30) Foreign Application Priority Data

Jun. 20, 2013 (DE) ..... 10 2013 211 708

(51) Int. Cl.
*G09G 3/00* (2006.01)
*G09G 3/3208* (2016.01)
(Continued)

(52) U.S. Cl.
CPC ..... *G09G 3/006* (2013.01); *G09G 3/3208* (2013.01); *G09G 3/3233* (2013.01);
(Continued)

(58) Field of Classification Search
CPC ..... G09G 2380/10; G09G 2330/12; G09G 3/3648; G09G 3/006; G09G 2320/029; G09G 3/3233; G09G 3/3208
See application file for complete search history.

(56) References Cited

U.S. PATENT DOCUMENTS 6,710,548 B2 3/2004 Kimura
8,410,788 B2 4/2013 Hartrarnpf et al.
(Continued)

FOREIGN PATENT DOCUMENTS

CN 100356416 C 12/2007
DE 10 2007 062 510 A1 7/2009
WO WO 2013/150109 10/2013

OTHER PUBLICATIONS

Office Action dated Mar. 6, 2018 issued in the corresponding Chinese Patent Application No. 201480046087.4.

*Primary Examiner* — Abhishek Sarma
(74) *Attorney, Agent, or Firm* — Cozen O'Connor

(57) ABSTRACT

In a test method, a screen in a vehicle is actuated in order to generate a specified raster image. An electric current intensity flowing as a result of the actuation is measured, and the measured current intensity is compared with a specified reference current intensity. It is ascertained whether the raster image was generated without errors dependent on the comparison.

13 Claims, 1 Drawing Sheet

(51) Int. Cl.
*G09G 3/36* (2006.01)
*G09G 3/3233* (2016.01)

(52) U.S. Cl.
CPC ..... *G09G 3/3648* (2013.01); *G09G 2320/029* (2013.01); *G09G 2330/12* (2013.01); *G09G 2380/10* (2013.01)

(56) References Cited

U.S. PATENT DOCUMENTS

| | | | | |
|---|---|---|---|---|
| 2002/0014851 | A1 | 2/2002 | Tai et al. | |
| 2003/0222672 | A1 | 12/2003 | Winer | |
| 2004/0036820 | A1* | 2/2004 | Runolinna | G09G 3/3611 349/61 |
| 2009/0128540 | A1* | 5/2009 | Hsu | G09G 3/3611 345/213 |
| 2010/0225635 | A1 | 9/2010 | Murahashi et al. | |
| 2010/0301876 | A1* | 12/2010 | Hartrampf | G09G 3/006 324/656 |
| 2011/0210952 | A1 | 9/2011 | Safavi et al. | |

* cited by examiner

TEST METHOD FOR A SCREEN IN A VEHICLE

CROSS-REFERENCE TO RELATED APPLICATIONS

This is a U.S. national stage of application No. PCT/EP2014/061073, filed on 28 May 2014, which claims priority to the German Application No. 10 2013 211 708.6 filed 20 Jun. 2013, the content of both incorporated herein by reference.

BACKGROUND OF THE INVENTION

1. Field of the Invention

The invention relates to a test method for a screen in a vehicle and to a corresponding test apparatus.

2. Related Art

In modern vehicles, full-area screens are frequently used as a display, particularly in a combination instrument in the vehicle, instead of warning lamps. By way of example, these screens are also used to provide safety-relevant displays, such as warnings.

SUMMARY OF THE INVENTION

An object of the invention is to provide firstly a method and secondly an apparatus that contribute to the testing of the operation of a screen in a vehicle.

According to aspects of the invention, a test method and a corresponding test apparatus are provided. A screen in a vehicle is actuated to produce a prescribed raster image. An electrical current intensity flowing as a result of the actuation of the screen is measured. The measured current intensity is compared with a prescribed reference current intensity. The comparison of the reference current intensity with the measured current intensity is taken as a basis for ascertaining whether the raster image has been produced without error.

The screen is particularly a flat screen.

In this case, the prescribed raster image corresponds to a pattern that is suitable for specifically checking a prescribed region of the screen. This allows specific checking of different regions of the screen.

By way of example, the reference current intensity is measured and stored when the screen is manufactured or developed. This involves the prescribed raster image being produced and the reference current intensity measured, for example at the end of production. If the electrical current intensity measured later in the test method is not equal to the reference current intensity, if need be minus a tolerance, then it can be inferred that individual pixels and/or line or column drivers of the screen are faulty.

The comparison of the measured current intensity with the prescribed reference current intensity therefore provides a simple way of ascertaining whether the screen produces the prescribed raster image without error.

By way of example, the prescribed raster image is an individual warning or a combination of a plurality of warnings, or a part, such as an individual column or an individual row or an individual region of a warning. By way of example, such a warning is a display for worn brake pads, excessively low brake fluid, excessively high coolant temperature, excessively little oil, an excessively low oil pressure, faulty power supply, a passenger not wearing a seatbelt, engine problems, deactivated ESP, preheating glowplugs, rear fog lamp switched on, reduced tire pressure, an airbag warning and/or a gear display.

According to one advantageous embodiment, the current intensity that is used to supply the screen with current is measured and is compared with the prescribed reference current intensity.

Precisely the supply current intensity, that is to say the current intensity that is used to supply the screen with current, can be measured in a simple manner and the level thereof is dependent on which raster image needs to be produced. Hence, it is a very simple matter to check whether the screen is operational.

According to a further advantageous embodiment, the current intensity flowing at a driver stage of the screen is measured and is compared with the prescribed reference current intensity.

As a result, it is a very simple matter to check whether individual driver stages, such as column and/or row drivers and/or shift registers for the screen, are operational. In particular, this involves the measurement of the current intensity being performed using what is known as the common voltage circuit (VCOM) and/or using what is known as the source driver stage.

According to a further advantageous embodiment, the current intensity flowing for charging at least one pixel of the screen is measured and is compared with the prescribed reference current intensity.

As a result, it is a simple matter to check the operation of the individual pixels of the screen.

According to a further advantageous embodiment, the screen is a luminescent screen.

In the case of luminescent screens, such as OLED screens, the current intensity can be measured in a very simple manner. In addition, particularly in the case of luminescent screens, the current intensity is dependent on the raster image produced.

According to a further advantageous embodiment, the screen is a TFT liquid crystal screen.

TFT liquid crystal screens are inexpensive and are frequently installed in vehicles. In the case of TFT liquid crystal screens too, the current intensity can be measured in a very simple manner.

According to one advantageous embodiment, the actuation is effected with the backlight not switched on.

As a result, the measurement can be performed such that a vehicle driver may notice nothing about the measurement.

According to a further advantageous embodiment, the actuation is effected a short time after the screen is switched on.

By way of example, the actuation is effected within a few seconds, for example within 3 seconds, after the screen is switched on. As a result, the check can be performed in the manner of a regular lamp check in vehicles, for example. In the case of a regular lamp check, all warnings are briefly displayed in succession or simultaneously, for example, so the vehicle driver can check them.

According to one advantageous embodiment, the reference current intensity is ascertained on the basis of data from a graphics memory.

Precisely in the case of luminescent screens, such as OLED screens, data from the graphics memory, that is to say the data that convey which raster image is displayed at the moment, can be taken as a basis for ascertaining how much current would need to flow on the screen just now. Hence, it is a simple matter to use any desired raster image to check the operation of the screen at any desired instant.

According to one advantageous embodiment, the current intensity that is used to supply a hidden point on the screen with current is measured. As a result, the measurement and display can be effected such that a vehicle user may not notice anything about the measurement of the current intensity.

According to one advantageous embodiment, a plurality of test methods or a plurality of advantageous embodiments of the test method are performed with different prescribed raster images and respectively associated reference current intensities. As a result, different warnings can be checked, for example.

According to one advantageous embodiment, the different prescribed raster images are produced at a prescribed frequency in succession that is greater than or equal to 20 Hz. As a result, it is possible to allow measurement of a plurality of raster images, of which the vehicle user may notice nothing on account of the inertia of his eye.

BRIEF DESCRIPTION OF THE DRAWINGS

Exemplary embodiments are explained in more detail below with reference to schematic drawings, in which.

DETAILED DESCRIPTION OF THE PRESENTLY PREFERRED EMBODIMENTS

Figure 1:
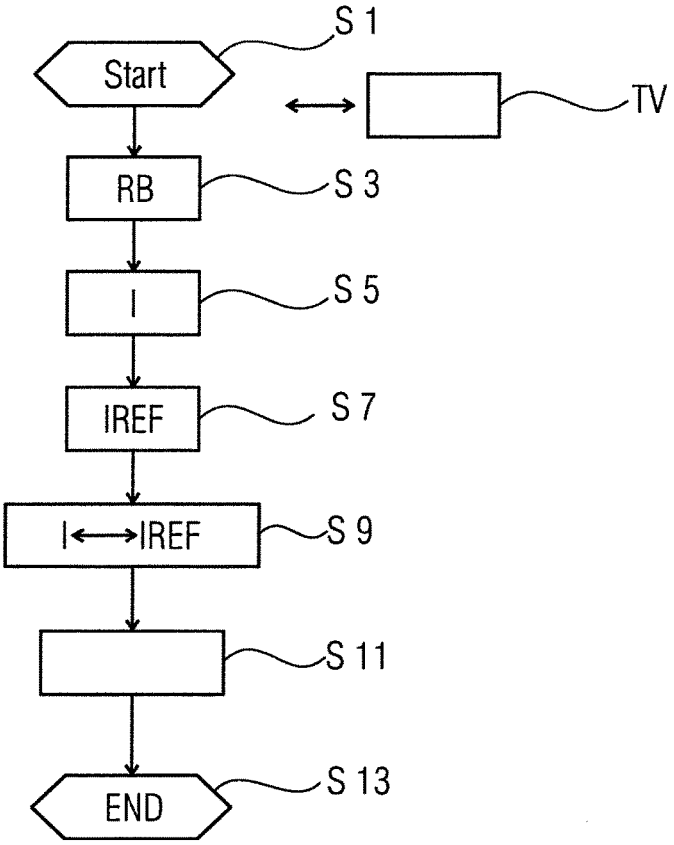
FIG. 1 shows a flowchart.

FIG. 1 shows a flowchart for a program for testing a screen 1 in a vehicle. The program is preferably stored in a program and data memory of a test apparatus TV.

For this purpose, the test apparatus TV comprises, by way of example, a computation unit, a program and data memory and, by way of example, an interface. The computation unit and/or the program and data memory may be produced in one unit and/or in a manner distributed over a plurality of units. The test apparatus TV is preferably arranged permanently in a vehicle.

Figure 2:
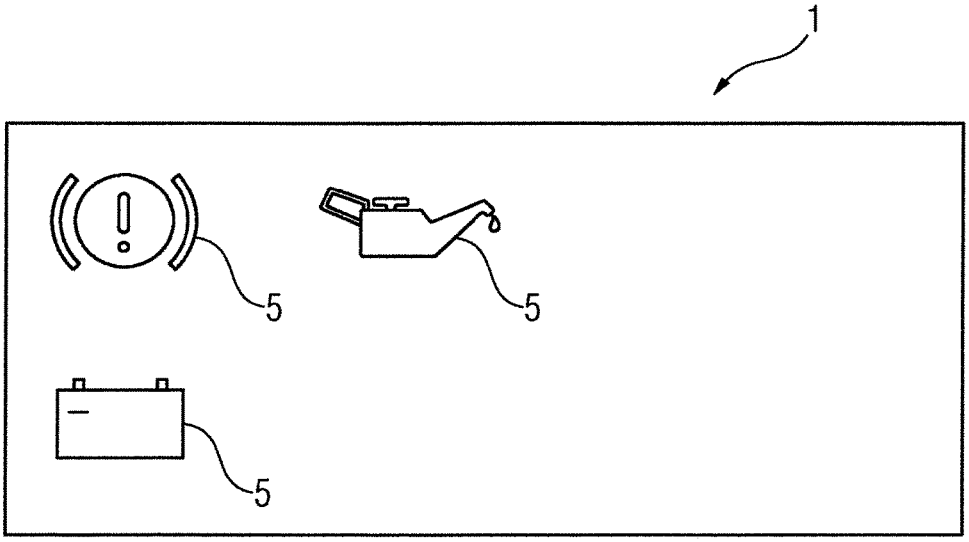
FIG. 2 shows a display on a screen.

By way of example, the interface is designed to communicate with a screen 1 (see FIG. 2). The screen 1 is, in particular, a flat screen and/or, by way of example, a luminescent screen, such as an OLED screen, or alternatively a nonluminescent screen, such as a TFT liquid crystal screen. By way of example, the screen 1 is arranged in the combination instrument of the vehicle and configured to display warnings 5. By way of example, such warnings 5 are a display for worn brake pads, excessively low brake fluid, excessively high coolant temperature, excessively little oil, an excessively low oil pressure, faulty power supply, a passenger not wearing a seatbelt, engine problems, deactivated ESP, preheating glowplugs, rear fog lamp switched on, reduced tire pressure, an airbag warning and/or a gear display.

The program is started in a step S1 (see FIG. 1), in which variables can be initialized if need be.

In a step S3, the screen 1 is activated to produce a prescribed raster image RB. By way of example, the raster image RB comprises one or more warnings 5, as are shown in FIG. 2. Alternatively, the raster image RB may also comprise, by way of example, just part of a warning 5, such as individual rows and/or columns of the warnings 5.

In a step S5, an electrical current intensity I flowing as a result of the actuation is measured. The measured current intensity I is a current intensity I that is used to supply the screen 1 with current, for example.

Alternatively or additionally, the measured current intensity I is a current intensity I that flows at a driver stage of the screen 1, such as a column and/or row driver and/or a shift register.

Alternatively or additionally, the measured current intensity I is a current intensity I that flows for charging at least one pixel of the screen 1.

Alternatively or additionally, the measured current intensity I is a current intensity I that flows through a common node for all column and/or row drivers and/or shift registers.

By way of example, the current intensity I can be measured by a respective voltage drop and/or by another suitable method for current measurement. By way of example, the current intensity I can be measured at the whole screen 1 or else just at a prescribed region or a plurality of regions, such as a respective region of 32×32 pixels, at individual columns and/or rows and/or at individual pixels. For this purpose, it is possible for suitable measurement options to be integrated into respective row and/or column driver chips of the screen 1, for example.

In a step S7, a reference current intensity IREF is provided. By way of example, the reference current intensity IREF is permanently stored, for example in the data and program memory of the test apparatus TV. By way of example, the reference current intensity IREF is measured when the screen 1 is developed or manufactured. This involves the prescribed raster image RB being produced and the reference current intensity IREF measured, for example at the end of production. The reference current intensity IREF can be collated or calibrated once again at the end of the line, for example in the case of vehicle production.

In a step S9, the measured current intensity I is compared with the prescribed reference current intensity IREF.

On the basis of the comparison, a step S11 ascertains whether the raster image RB has been produced without error. By way of example, this involves checking whether the measured current intensity I is in a prescribed tolerance range around the reference current intensity IREF.

In a step S13, the program is terminated and can be started again in step S1 if need be.

The program can also be performed for a plurality of warnings 5 repeatedly in succession, for example with different prescribed raster images RB and respective associated reference current intensities IREF.

By way of example, the electrical current intensity I is measured when the screen 1 is switched on and off, for example shortly after the screen 1 is switched on or shortly before it is switched off.

In the case of luminescent screens 1, for example, the current intensity I of the start or end screen can be measured directly, and compared with the reference current intensity IREF, when switching on or off. In the case of a nonluminescent screen 1, the measurement can be effected, by way of example, with the backlight not switched on, for example after the backlight is switched off or before it is switched on.

If the measurement is performed when the screen 1 is switched on, it is possible for the measurement to be presented as a regular lamp check in which, by way of example, all warnings 5 are briefly displayed in succession or simultaneously, so that the vehicle driver can check them.

Alternatively, the measurement can also be effected such that the raster image RB is produced such that a vehicle user is not aware of the measurement. This can be achieved when a plurality of raster images RB are being produced, for example, using a suitably high frequency, such as greater than or equal to 20 Hz, when the raster images RB are being produced.

Alternatively or additionally, this can be achieved by virtue of the measurement and actuation of the screen 1 being performed at a row or column driver that actuates a hidden row, or column, at the edge of the screen 1. Instead of individual warnings 5, it is alternatively or additionally possible, by way of example, for a raster image RB having a plurality of warnings 5 situated next to one another or above one another to be produced too and for the current intensity I invariably to be measured on a column-by-column basis, for example, in the case of warnings 5 situated next to one another and on a row-by-row basis in the case of warnings 5 situated above one another.

When individual rows and/or columns and/or regions are checked, the program can be performed repeatedly in succession for different rows and/or columns and/or regions.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A test method comprising:

retrieving a prescribed reference current intensity measured and stored when a screen is manufactured;

actuating the screen in a vehicle to produce a prescribed raster image;

measuring an electrical current intensity flowing in at least one of an individual column driver, an individual row driver, and an individual shift register for the screen as a result of the actuating;

comparing the measured electrical current intensity with the prescribed reference current intensity; and ascertaining whether the raster image has been produced without error based on the comparing, wherein the screen has a backlight and the actuating is effected with the backlight not switched on.

2. The test method as claimed in claim 1, wherein an electrical current intensity used to supply the screen with current is used in the measuring and is compared with the prescribed reference current intensity in the comparing.

3. The test method as claimed in claim 1, wherein the electrical current intensity flowing at a common node for all driver stages of the screen is used in the measuring and is compared with the prescribed reference current intensity in the comparing.

4. The test method as claimed in claim 1, wherein an electrical current intensity flowing for charging at least one pixel of the screen is used in the measuring and is compared with the prescribed reference current intensity in the comparing.

5. The test method as claimed in claim 1, in which the screen is a luminescent screen.

6. The test method as claimed in claim 1, in which the screen is a TFT liquid crystal screen.

7. The test method as claimed in claim 1, wherein the actuating is effected in response to a switching on of the screen.

8. The test method as claimed in claim 1, wherein the reference current intensity is ascertained based on data from a graphics memory.

9. The test method as claimed in claim 1, wherein the electrical current intensity used to supply a hidden point on the screen with current is used in the measuring.

10. A test method according to claim 1 in which testing is performed with different prescribed raster images and respectively associated reference current intensities.

11. The test method as claimed in claim 10, wherein the different prescribed raster images are imperceptibly produced at a prescribed frequency in succession that is greater than or equal to 20 Hz.

12. A test apparatus, wherein the test apparatus is configured to carry out a test method as claimed in claim 1.

13. The test method as claimed in claim 1, wherein the electrical current intensity flowing in at least one of the individual column driver, the individual row driver, and the individual shift register for the screen as a result of the actuating within about three seconds of the screen being switched on.

* * * * *